US010240811B2

(12) United States Patent
Zanqueta et al.

(10) Patent No.: US 10,240,811 B2
(45) Date of Patent: Mar. 26, 2019

(54) AIR-CONDITIONING APPARATUS WITH VIBRATION-DAMPER

(71) Applicant: Electrolux Do Brasil S. A., Curitiba (BR)

(72) Inventors: Hugo Flavio Benassi Zanqueta, Curitiba (BR); Danilo Toshio Fusano, Curitiba (BR); Felipe Rosa Ormelez, Pinhais (BR)

(73) Assignee: Electrolux Do Brasil S.A., Curitiba (BR)

( * ) Notice: Subject to any disclaimer, the term of this patent is extended or adjusted under 35 U.S.C. 154(b) by 0 days.

(21) Appl. No.: 15/596,583

(22) Filed: May 16, 2017

(65) Prior Publication Data

US 2017/0314811 A1 Nov. 2, 2017

Related U.S. Application Data

(62) Division of application No. 14/385,219, filed as application No. PCT/BR2013/000085 on Mar. 15, 2013, now Pat. No. 9,683,754.

(30) Foreign Application Priority Data

Mar. 15, 2012 (BR) ..... 102012005849

(51) Int. Cl.
*F24F 13/20* (2006.01)
*F24F 13/24* (2006.01)
(Continued)

(52) U.S. Cl.
CPC ..... *F24F 13/20* (2013.01); *F24F 1/02* (2013.01); *F24F 1/027* (2013.01); *F24F 13/24* (2013.01);
(Continued)

(58) Field of Classification Search
CPC .. F24F 13/20; F24F 13/24; F24F 13/32; F24F 1/027; F24F 2013/242; F24F 2013/247
See application file for complete search history.

(56) References Cited

U.S. PATENT DOCUMENTS 1,531,159 A * 3/1925 Timmons ..... A47L 3/02 248/236
2,758,456 A 8/1956 Wheeler
(Continued)

FOREIGN PATENT DOCUMENTS

EP 1300635 4/2003
JP 2008064344 3/2008

OTHER PUBLICATIONS

International Search Report for PCT/BR2013/000085, dated Jul. 23, 2013, 2 pages.

*Primary Examiner* — Andrew M Roersma
(74) *Attorney, Agent, or Firm* — Pearne & Gordon LLP

(57) ABSTRACT

An air-conditioning apparatus, for treating air in enclosed environments, endowed with a constructive arrangement capable of absorbing vibrations of its inner components. The air-conditioning apparatus includes at least a cabinet, arranged to accommodate internal components of the apparatus, endowed with at least an outer face. The apparatus includes at least an absorber capable of absorbing vibrations from internal components of the apparatus. The absorber is disposed tangentially to at least an outer face of the cabinet.

7 Claims, 6 Drawing Sheets

(51) Int. Cl.
*F24F 1/02* (2011.01)
*F24F 13/32* (2006.01)
*F24F 1/027* (2019.01)

(52) U.S. Cl.
CPC ..... *F24F 13/32* (2013.01); *F24F 2013/242* (2013.01); *F24F 2221/20* (2013.01); *F24F 2221/36* (2013.01)

(56) References Cited

U.S. PATENT DOCUMENTS 2,814,244 A * 11/1957 Hord ..... F24F 1/04 454/203
2,871,778 A * 2/1959 Brehm, Jr. ..... F24F 1/04 454/204
2,889,764 A * 6/1959 McGrath ..... F24F 1/04 248/208
2,935,284 A * 5/1960 Reeves ..... E04G 3/18 248/208
2,945,358 A 7/1960 MacLeod
2,946,274 A * 7/1960 Grimes, Jr. ..... E06L 37/02 248/236
2,998,711 A 9/1961 Komroff
3,030,873 A 4/1962 Metcalfe
3,111,076 A 11/1963 Martin, Jr.
3,246,593 A * 4/1966 Jacobs ..... F24F 1/04 454/203
3,273,843 A * 9/1966 Bell, Jr. ..... F24F 13/32 248/208
3,394,910 A * 7/1968 Ulich ..... F24F 13/00 248/208
3,680,258 A 8/1972 Loyd
3,844,204 A * 10/1974 Ball ..... E06B 1/26 454/204
3,926,881 A * 12/1975 Kracklauer ..... C08K 5/02 524/176
4,573,328 A * 3/1986 Bolton ..... F24F 13/32 248/27.1
5,046,791 A 9/1991 Kooiman
5,112,015 A * 5/1992 Williams ..... F16M 13/022 248/228.3
5,135,413 A * 8/1992 Pannizzo ..... E06B 7/28 174/481
5,967,478 A * 10/1999 Tynes ..... A47B 45/00 248/208
5,979,533 A * 11/1999 Dupuie ..... F24F 1/0003 160/240
6,418,621 B1 * 7/2002 Namovich ..... F24F 1/027 29/525.11
6,640,499 B2 11/2003 Yamashita
7,350,759 B1 * 4/2008 Gray ..... F24F 1/027 248/644
7,975,441 B2 * 7/2011 McCarriston ..... F24F 1/027 248/208
9,683,754 B2 * 6/2017 Zanqueta ..... F24F 13/20
2003/0087598 A1 5/2003 Adams
2007/0235610 A1 * 10/2007 Flanigan ..... E06B 7/28 248/231.71
2009/0169821 A1 * 7/2009 Takeuchi ..... B29C 44/005 428/156
2010/0307862 A1 12/2010 Yamauchi
2013/0153744 A1 * 6/2013 Jin ..... F24F 13/32 248/670
2015/0253034 A1 9/2015 Zanqueta

* cited by examiner

AIR-CONDITIONING APPARATUS WITH VIBRATION-DAMPER

FIELD OF THE INVENTION

The invention refers to an air-conditioning apparatus and, more specifically, the invention refers to an air-conditioning apparatus of the window type, particularly for residential or commercial application, endowed with a constructive arrangement capable of absorbing at least partially vibrations coming from one or more of its inner components.

BACKGROUND OF THE INVENTION

The concept of air-conditioning originated from the need to meet a to demand for climatically controlled environments by: the graphics, textile, pharmaceutical and cellulose (paper) industries, in which production was adversely affected, primarily due to the undesirable conditions of humidity and temperature of the environment, which directly influenced the working of the equipment and processes used.

Initially, air-conditioning was done by means of ducts and large-scale equipment, capable of cooling and withdrawing the humidity from the air and allowing its circulation in an enclosed environment. Subsequently, smaller-scale air-conditioners were developed, whereby enabling their use in homes and business establishments.

Today, air-conditioning apparatuses are relatively cheap and quite compact, and can be installed even in environments with reduced space. Because of this, their use has become quite widespread, principally in hot regions, and two of the most well-known types of air-conditioners are window type and split type, which are briefly described ahead.

Air-conditioners of the split type comprise two distinct modules or units, called inner unit (evaporator) and outer unit (condenser); and one of its advantages lies in the fact that the inner unit is relatively more silent in comparison to the air-conditioners of the window type. Moreover, the costs of air-conditioners of the split type are, in general, relatively higher than those of the window type. Additionally, its installation/maintenance is more complex and, accordingly, requires specialist labor, in addition to specific materials/accessories, which also involves greater cost. Moreover, although the evaporator unit is relatively more silent, the condenser unit generates considerable noise in the external environment, rendering implementation thereof unfeasible, principally in large numbers, in buildings and establishments where it is necessary to maintain an acceptable level of external noise (for instance, hospitals, libraries and schools.

The air-conditioners of the window type, in turn, consist of apparatuses endowed with a single cabinet that comprises all the parts and components needed for cooling or heating the air mounted inside the cabinet. Said apparatuses are easily installed by coupling to windows or openings made in the wall (which can be carried out by means of a direct coupling or by means of a pre-fabricated encasement module), one part facing the internal environment (enclosed) of a place and the other pert facing the external environment (open) to the place. However, the air-conditioners of the window type also present certain drawbacks, such as high noise level coming mainly from the vibration of its components (e.g. compressors and ventilators/blowers). These undesirable vibrations are transmitted from the apparatus through its cabinet to a wall or structure where it is installed, increasing noise pollution and causing major nuisance and discomfort to the occupants of this environment where it is installed.

Therefore, both air-conditioners of the window type and split-type present problems of noise and vibration. Some techniques are already known, which in principle could represent potential solutions for said problems. Patent documents JP 07-120106 and JP 3110329 present embodiments of buffering elements designed to reduce vibration of the components of air-conditioning system. However, the solutions shown in these documents from the state of the art require modifications in the internal structure of the air-conditioner, since they are applied directly to the components of the air-conditioner, and involve a relative technical complexity of adaptation and/or high production cost.

Thus, although the air-conditioning apparatuses of the state of the art meet the need to cool or heat an environment, they still present a high level of noise emission because of the vibrations of their inner components. particularly concerning the air-conditioning apparatuses of the window type.

DESCRIPTION OF THE INVENTION

Therefore, an objective of the present invention is to provide an air-conditioning apparatus for treating the air of enclosed environments, which is capable of reducing or eliminating the limitations of the technologies known in the state of the art.

It is also an objective of the invention to provide an air-conditioning apparatus of the window type that transmits a reduced noise level to the environment where it is installed, in relation to noise levels transmitted by the apparatuses known in the state of the art, so as to provide greater acoustic comfort for the occupants of this environment.

Additionally, an objective of the present invention consists of providing an air-conditioning apparatus, particularly for residential or commercial application, which is silent in comparison to the air-conditioning apparatuses of the state of the art.

A further objective of the present invention consists of providing an air-conditioning apparatus of the window type, particularly for residential or commercial applications, capable of reducing the transmission of the vibrations caused by internal components of the apparatus to a wall where it is installed.

One or more objectives of the present invention mentioned above, among others, is(are) achieved by an air-conditioning apparatus which comprises at least a cabinet, arranged to accommodate internal components of the apparatus, endowed with at least an outer face. Additionally, the air-conditioning apparatus comprises at least an absorber means capable of absorbing vibrations of internal components of the apparatus, and said absorber means is disposed tangentially to at least an outer face of the cabinet.

According to additional or alternative embodiments of the air-conditioning apparatus of the present invention, the following characteristics, alone or in combination, may also be comprised:

- the cabinet comprises a lower outer face, a left-side outer face, an upper outer face and a right-side outer face, the outer faces forming an internally hollow rectangular prism;
- the absorber means extends along the opposite ends of the lower outer face;
- the absorber means extends along the opposite ends of the left-side outer face;

the absorber means extends along the opposite ends of the upper outer face;

the absorber means extends along the opposite ends of the right-side outer face;

the absorber means consists of a single part, which extends along the perimeter of the outer faces of the cabinet;

the absorber means comprises a structure and a support base associated to each other;

said structure and said support base have different profiles to each other;

said structure simultaneously touches at least a portion of the left-side outer face, of the upper outer face and of the right-side outer face of the cabinet, and the support base is disposed tangentially to at least a portion of the lower outer face of the cabinet;

said structure has an L-shaped profile;

the support base has a profile endowed with at least a U-shaped cavity;

the profile of the support base is endowed with two U-shaped cavities;

the absorber means comprises at least an encasing frame, which simultaneously touches all the outer faces of the cabinet;

an encasing frame has a profile endowed with a U-shaped cavity and an H-shaped longitudinal opening;

the apparatus comprises a first encasing frame and the second encasing frame;

said first encasing frame is associable to an internal side of a wall of an environment where the apparatus is installed, and the second encasing frame is associable to an outer side of the wall of said environment;

the absorber means is made of flexible polymer;

the flexible polymer consists of an elastomer;

the elastomer consists of nitrile rubber or pure rubber;

the absorber means is associated to the outer face of the cabinet by means of adhesive; and the air-conditioning apparatus is of the window type.

BRIEF DESCRIPTION OF THE DRAWINGS

The objectives, technical effects and advantages Of the invention will be apparent to those skilled in the art from the detailed description below which makes reference to the accompanying drawings. Said drawings are schematic, their dimensions and proportions may not correspond to reality, since they are intended merely to illustrate the invention in a didactic manner and illustrate exemplary but not limitative embodiments of the invention. wherein.

DESCRIPTION OF EMBODIMENTS OF THE INVENTION

Initially, it has to be highlighted that the air-conditioning apparatus 1, object of the present invention, will now be described according to particular but not limitative embodiments, since their embodiments could be carried out in different ways and variations and in accordance with the desired application.

Preferentially, but not compulsorily, the air-conditioning apparatus 1 of the invention is of the window type, for installation in households or business establishments. Alternatively, the air-conditioning apparatus 1 may consist, for example, of a split-type or may be used in an industrial application.

Figure 1:
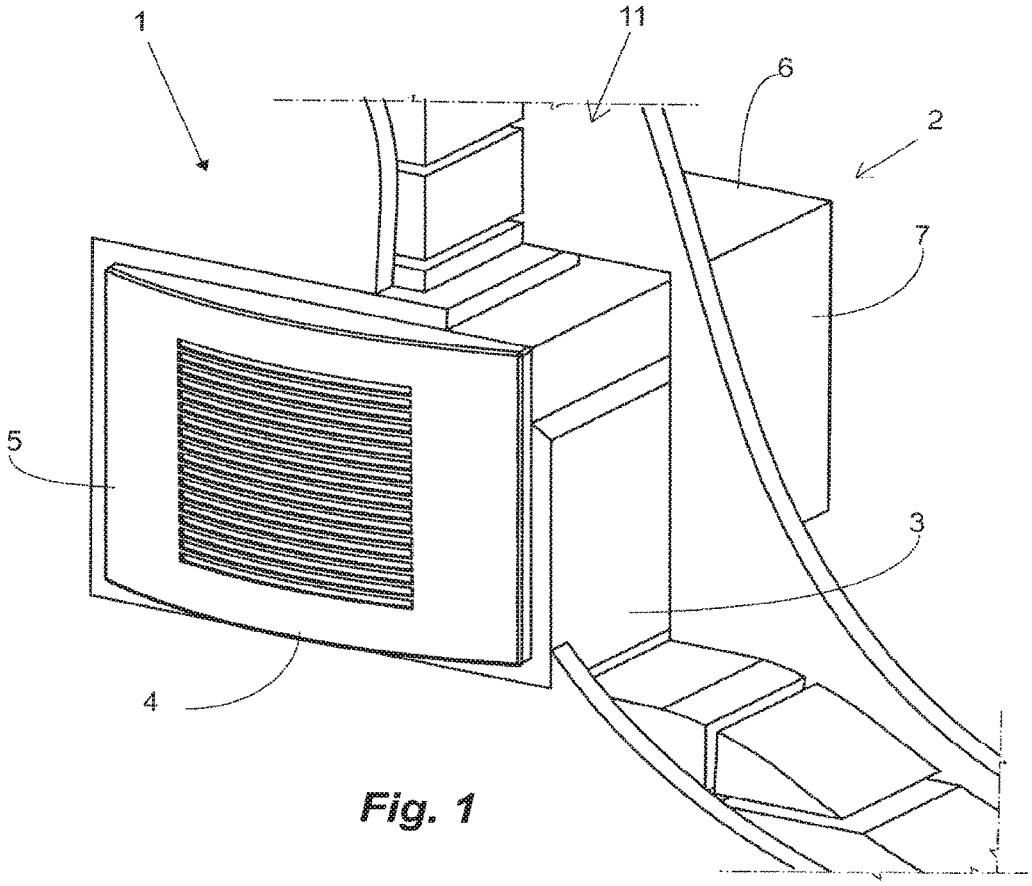
FIG. 1 illustrates a perspective view of an air-conditioning apparatus installed on a wall, according to a first particular embodiment of the present invention, in which the absorber means is shown in partial cut-away.
Figure 2:
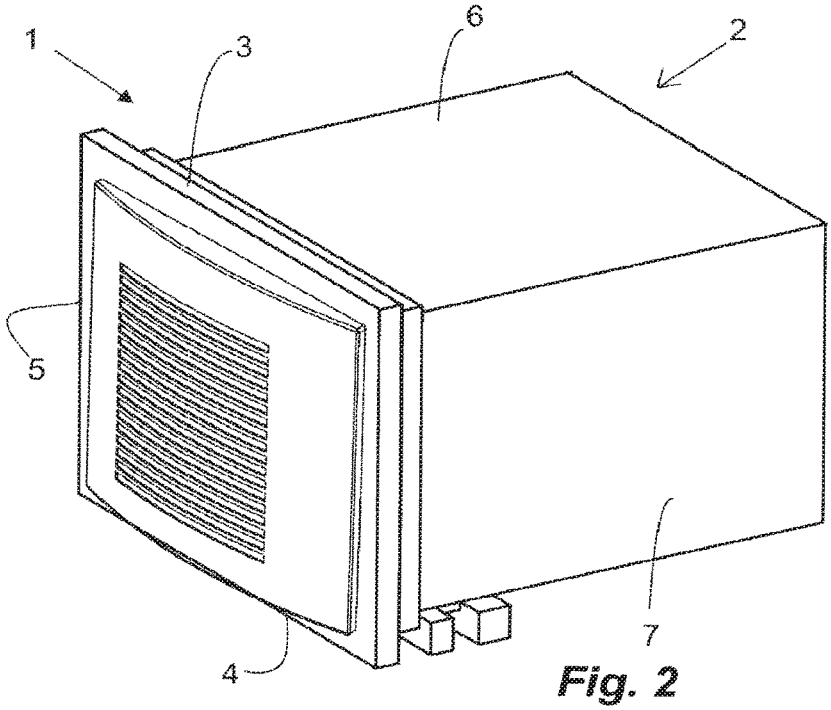
FIG. 2 illustrates a perspective view of an air-conditioning apparatus according to a second particular embodiment of the present invention.
Figure 3:
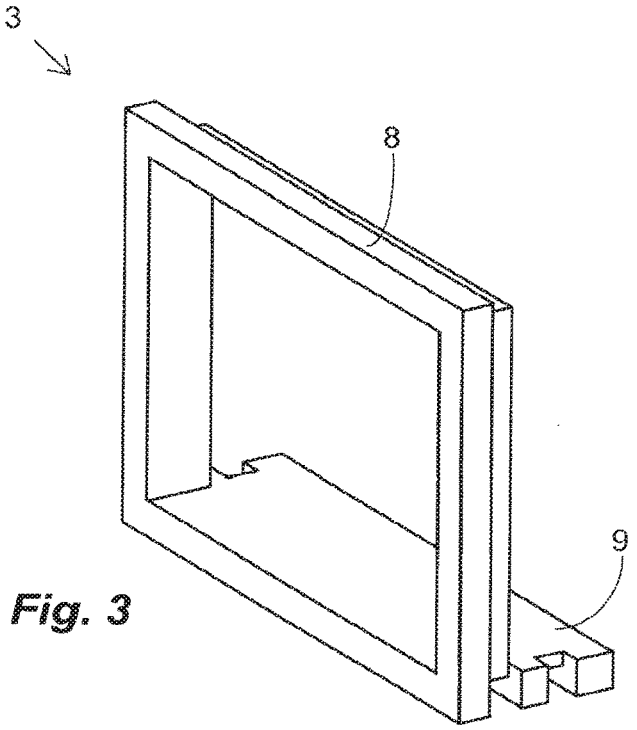
FIG. 3 illustrates a perspective (front) view of the absorber means of the air-conditioning apparatus shown in FIG. 2.
Figure 4:
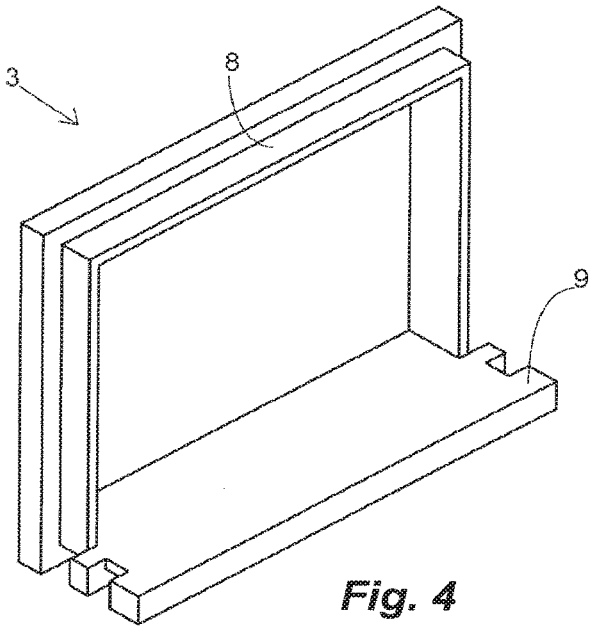
FIG. 4 illustrates a perspective (rear) view of the absorber means of the air-conditioning apparatus shown in FIG. 2.
Figure 9:
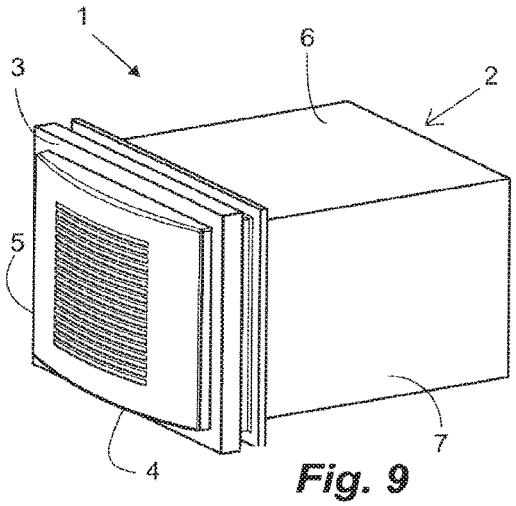
FIG. 9 illustrates a perspective view of an air-conditioning apparatus according to a third particular embodiment of the present invention.
Figure 10:
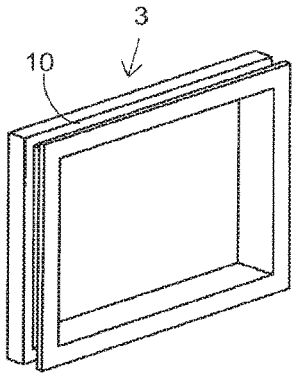
FIG. 10 illustrates a perspective (rear) view of the absorber means of the air-conditioning apparatus shown in FIG. 9.

According to FIGS. 1, 2 and 9, the air-conditioning apparatus 1 comprises at least a cabinet 2 arranged to accommodate internal components of the apparatus 1. Said internal components consist of, for example, compressor, condenser, evaporator, expansion valve thermostat, ventilator/blower etc., which are associated to each other by means of ducts and coils, so as to make up the cooling or heating system. Electrical or electronic circuits and systems also associated to the internal components may be present if the air-conditioning apparatus is controlled by electronic means.

The cabinet 2 is endowed with at least an chafer face 4, 5, 6, 7, and, in the particular embodiment of the invention, the cabinet 2 comprises four outer faces 4, 5, 6, 7, namely, a lower outer face 4, a left-side outer face 5, an upper outer face 6 and a right-side outer face 7, as can be seen in FIGS. 1, 2 and 9.

Further, according to FIGS. 1, 2 and 9, the four outer faces 4, 5, 6, 7 of the cabinet 2 form an internally hollow rectangular prism. In this cabinet arrangement 2, the outer faces 4, 5, 6, 7 are associated to a front panel and a rear panel, also comprised by apparatus 1. In other words, the air-conditioning apparatus 1 of the invention has particularly the format of a rectangular box whose sides are formed by the outer faces 4, 5, 6, 7, a front panel and a rear panel. Naturally, other formats and designs of the cabinet 2 can be used.

The air-conditioners of the window type generally comprise a single cabinet, whereas a split-type conditioner normally has two cabinets, one being to accommodate components of the evaporator unit and the other to accommodate components of the condensing unit.

The air-conditioning apparatus of the present invention further comprises at least an absorber means 3 capable of absorbing at least partially vibrations coming from the working of one or more internal components of the apparatus 1. As can be seen in FIGS. 1, 2 and 9, the absorber means 3 is disposed tangentially to at least an outer face 4, 5, 6, 7 of the cabinet 2. Particularly, the absorber means 3 is positioned between the cabinet 2 and a wall 11 where the apparatus 1 is installed (FIG. 1). This way, the absorber means 3 can be disposed as a stripe or furnishing in a contact region between the air-conditioning apparatus 1 and the wall 11.

Particularly, the absorber means 3 is associated to the outer face 4, 5, 6, 7 of the cabinet 2 by means of adhesive, which may be provided, for example, in the form of a label (double-sided) or by applying glue.

Regarding material, the absorber means 3 can be made of a flexible polymer, such as, for example, an elastomer which, in turn, may consist of nitrile rubber or pure rubber. Alternatively, other types of materials can be used that present a flexibility that is compatible with the application, such as, for example, silicone.

Thus, thanks to the combination of the constructive arrangement described above and the material used, the absorber means 3 is capable of reducing, at least partially, the transmission of the vibration of the components of the apparatus 1 to the wall 11, which also lowers the level of noise transmitted by the apparatus 1 to the environment where it is installed. In other words, the absorber means 3 acts as a vibration insulator, providing an apparatus 1 more silent and suited to use in internal environments, besides providing comfort to those who occupy the internal environment and, accordingly, may be installed in environments which cannot have loud noise. Additionally, the apparatus of the invention may eliminate the needed to use more expensive air-conditioning apparatuses, such as split-type apparatuses. Normally, the internal components that most contribute to the vibrations are the compressor and the ventilator, since they are associated to a relatively high-rotation gyratory movement. Said components will continue to vibrate and emit noise inside the cabinet 2, however, the absorber means 3 will act so as to absorb at least partially these vibrations and, consequently, reduce the transmission of noise of the apparatus 1 to the environment.

Particularly, the absorber means 3 extends along at least two opposite faces, such as the lower outer face 4 and/or the left-side outer face 5 and/or the upper outer face 6 and/or the right-side outer face 7, so as to provide greater efficiency in absorbing the vibrations, as a greater area is covered.

In the first particular embodiment of the apparatus 1 of the present invention, shown in FIG. 1, the absorber means 3 consists of a single part which extends along the perimeter of the outer faces 4, 5, 6, 7 of the cabinet 2 in a uniform manner.

According to a second particular embodiment of the apparatus 1 of the invention, illustrated in FIGS. 2 to 8, the absorber, means 3 comprises a structure 8 and a support base 9 associated to each other. This association can be done by means of adhesive and/or encasement. Optionally, the structure 8 and the support base 9 can be made as a single part.

Figure 5:
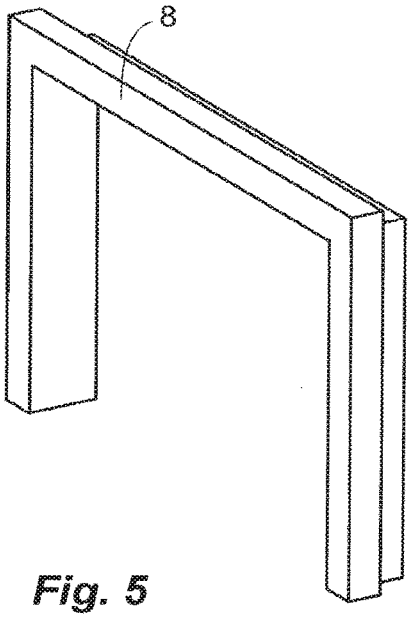
FIG. 5 illustrates a perspective view .of a structure of the absorber means shown in FIG. 4.

According to FIG. 2, the structure 8 of the, absorber means 3 simultaneously touches at least a portion of the left-side outer face 5, the upper outer face 6 and the right-side outer face 7 of the cabinet 2. Particularly, the structure 8 is an inverted U-shape (front view), as can be seen in FIG. 5. Further, according to FIG. 2, the support base 9 is disposed tangentially to at least a portion of the lower outer face 4 of the cabinet 2, placed between the cabinet and the wall where the apparatus is installed.

Figure 6:
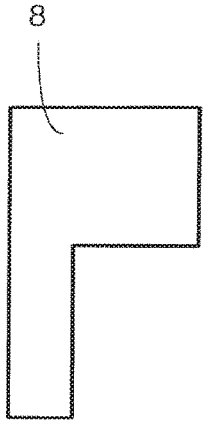
FIG. 6 illustrates a cross-sectional view of the profile of the structure shown in FIG. 5.
Figure 7:
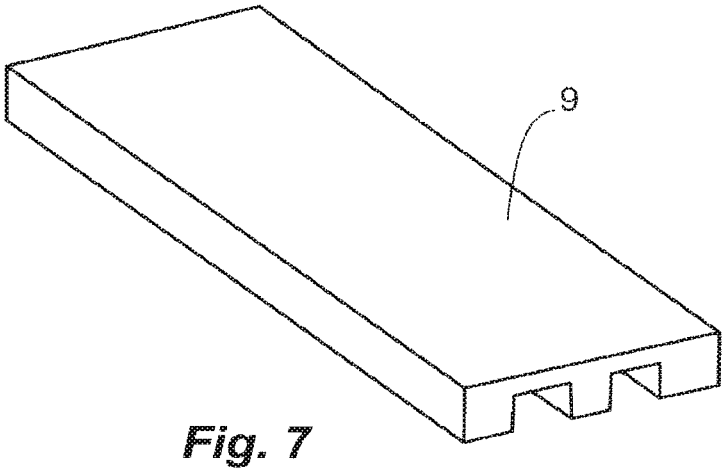
FIG. 7 illustrates a perspective view Of a profile of a support base of the absorber means shown in FIG. 4.
Figure 8:
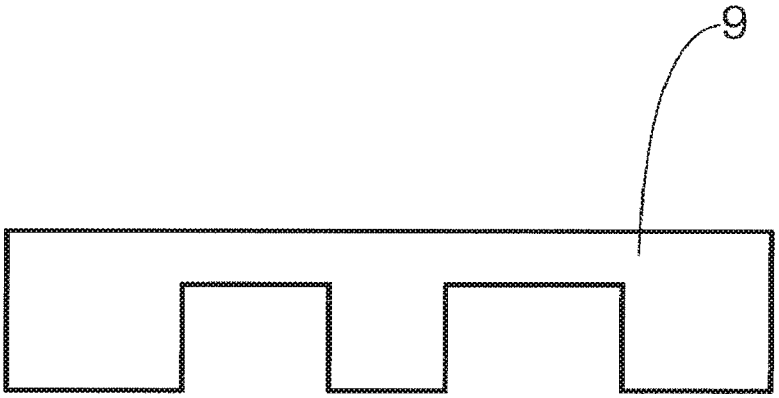
FIG. 8 illustrates a cross-sectional view of the profile of the support base shown in FIG. 7.

The structure 8 and the support base 9 may have different profiles to each other. Particularly, according to this embodiment illustrated, the structure 8 has an L-shaped profile (cross-section), as shown in FIG. 6. Also particularly, the support base a may have a profile endowed with at least a U-shaped cavity, as can be seen in FIGS. 7 and 8. Particularly, the profile of the support base 9 is endowed with two U-shaped cavities.

Figure 11:
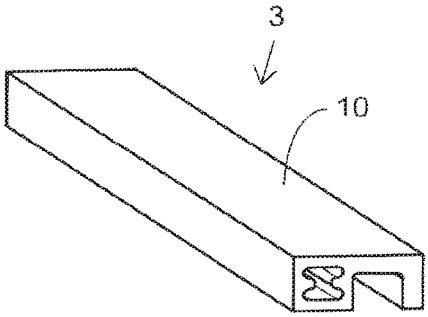
FIG. 11 illustrates a perspective view of a profile of the absorber means shown in FIG. 10.
Figure 12:
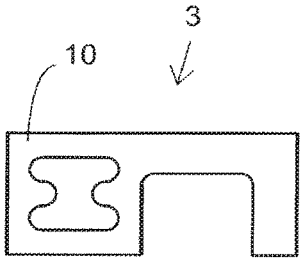
FIG. 12 illustrates a cross-sectional view of the profile shown in FIG. 11.

In a third particular embodiment of the present invention, illustrated in FIGS. 9 to 12, the absorber means 3 comprises at least an encasing frame 10 which simultaneously touches all the outer faces 4, 5, 6, 7 of the cabinet 2. Particularly, the encasing frame 10 has a profile endowed with a U-shaped cavity and an H-shaped longitudinal opening, as can be seen in FIGS. 11 and 12. Said U-shaped cavity is arranged to fit/encase into the wall 11.

Figure 13:
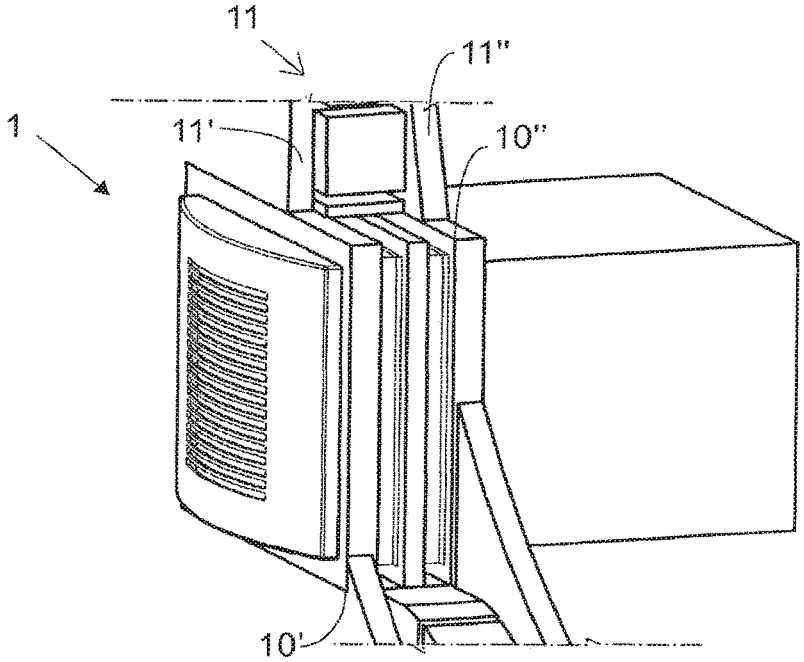
FIG. 13 illustrates a first way of installing the third embodiment of the air-conditioning apparatus of the present invention, using two absorber means.
Figure 14:
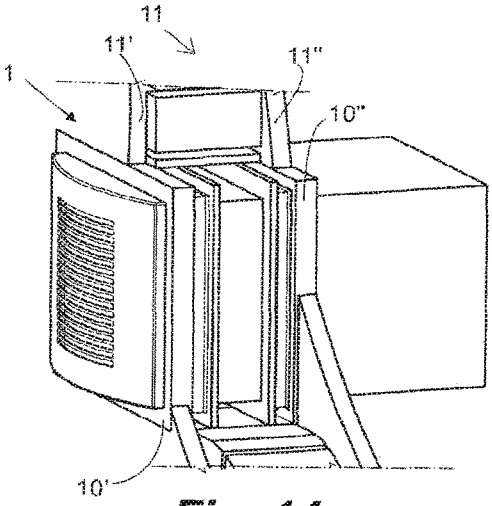
FIG. 14 illustrates a second way of installing the third embodiment of the air-conditioning apparatus of the present invention, using two absorber means.
Figure 15:
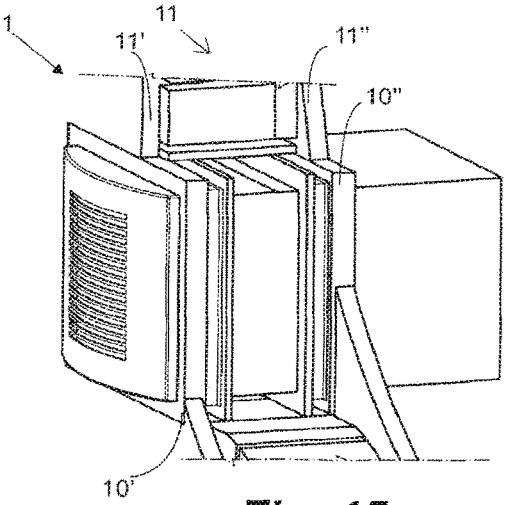
FIG. 15 illustrates a third way of installing the third embodiment of the air-conditioning apparatus of the present invention, using two absorber means.

In a variation of this third particular embodiment, the apparatus 1 comprises a first encasing frame 10' and the second encasing frame 10", and the first encasing frame 10' is associable to an internal side 11' of the wall 11 of the environment where the apparatus 1 is installed and the second encasing frame 10" is associable to an outer side 11' of the wall 11 of said environment, as shown in FIGS. 13 to 15. In this variation, the first encasing frame 10' and the second encasing frame 10" are positioned in parallel form to each other, and the distance between them may be adjusted according to the thickness of the wall 11 where the apparatus 1 is installed. For example, FIGS. 13 to 15 show three distinct installment conditions, in which the distance between the first encasing frame 10' and the second encasing frame 10" is adjusted according to the thickness of the wall 11. Owing to this arrangement, any kind of direct contact of the cabinet 2 with the wall 11 is eliminated.

Although the description of the particular embodiments above draws references to commercial or residential applications, the air-conditioning apparatus of the present invention can be used for other types of applications and may present modifications in their form of implementation, such that the scope of protection of the invention is limited solely by the content of the accompanying claims, including all the possible equivalent variations.

What is claimed is:

1. An air-conditioning apparatus comprising a cabinet arranged to accommodate internal components of the apparatus, the cabinet having an outer face, wherein the apparatus comprises at least one vibration absorber disposed tangentially to at least a portion of the outer face of the cabinet and the at least one vibration absorber comprises a structure and a separate support base attached to each other, wherein the support base is made of a flexible polymer and extends from a rear face of the structure and includes a projection extending laterally from each side surface of the support base, each projection engaging the rear face of the structure, and wherein a lower planar surface of the outer face of the cabinet rests on an upper planar surface of the support base.

2. The apparatus, as claimed in claim 1, wherein said structure and said support base have different profiles to each other.

3. The apparatus, as claimed in claim 1, wherein the outer face of the cabinet further comprises a left-side outer face, an upper outer face and a right-side outer face and said structure simultaneously touches at least a portion of the left-side outer face, of the upper outer face and of the right-side outer face of the cabinet.

4. The apparatus, as claimed in claim 1, wherein the support base has a profile including at least one U-shaped cavity.

5. The apparatus, as claimed in claim 1, wherein the support base has a profile including two U-shaped cavities.

6. The apparatus, as claimed in claim 1, wherein the vibration absorber has a profile including a U-shaped cavity defined by a first wall and a second wall parallel to and thicker than the first wall.

7. The apparatus, as claimed in claim 1, wherein the structure has an L-shaped profile.

* * * * *